United States Patent [19]

Juds et al.

[11] 4,046,451

[45] Sept. 6, 1977

[54] CONNECTOR FOR COAXIAL CABLE WITH ANNULARLY CORRUGATED OUTER CONDUCTOR

[75] Inventors: Richard C. Juds, Dolton; Dennis M. Healy, Oak Lawn, both of Ill.

[73] Assignee: Andrew Corporation, Orland Park, Ill.

[21] Appl. No.: 703,462

[22] Filed: July 8, 1976

[51] Int. Cl.[2] ..... H01R 17/18

[52] U.S. Cl. ..... 339/177 R; 174/75 C; 285/DIG. 4; 339/60 C; 339/94 C

[58] Field of Search ..... 174/21 C, 75 C, 88 C; 285/DIG. 4; 339/177 R, 177 E, 60 C, 94 C

[56] References Cited

U.S. PATENT DOCUMENTS

| | | | |
|---|---|---|---|
| 3,040,288 | 6/1962 | Edlen | 174/88 C |
| 3,291,895 | 12/1966 | Van Dyke | 339/177 R |
| 3,678,446 | 7/1972 | Siebelist | 339/177 E |

FOREIGN PATENT DOCUMENTS

| | | | |
|---|---|---|---|
| 2,221,931 | 11/1973 | Germany | 339/177 R |

*Primary Examiner*—Roy Lake
*Assistant Examiner*—Mark S. Bicks
*Attorney, Agent, or Firm*—Leydig, Voit, Osann, Mayer & Holt, Ltd.

[57] ABSTRACT

A connector assembly for a coaxial cable having an annularly corrugated outer conductor has a first unitary clamping member which fits over the end of the coaxial cable and forms an inwardly extending bead at one end thereof for meshing with the last valley in the corrugated outer conductor, thereby locking the clamping member to the cable in the axial direction. One side of the bead also forms a first conically beveled clamping surface for engaging the outer surface of the last crest in the corrugated outer conductor. When the clamping member is advanced over the cable during installation of the connector assembly, the bead cams a plurality of resilient segments in the beaded end of the clamping member outwardly to clear the crest of the corrugated outer conductor. The resilient segments are formed by a plurality of longitudinal slits, and the camming of these segments outwardly during installation of the clamping member permits the bead to pass over the crest of the corrugated outer conductor before it snaps into its locked position. A second conically beveled clamping surface, preferably formed as an integral part of the main body member of the connector, engages the inner surface of the last crest in the corrugated outer conductor of the cable. Telescoping sleeves formed as integral parts of the clamping member and the body member are provided with cooperating threaded surfaces which serve to draw and hold the two clamping surfaces together against opposite surfaces of the outer conductor of the cable. An outwardly projecting bead on the clamping member minimizes the area of frictional engagement between the unthreaded surfaces of the two members to avoid rotation of the clamping member around the cable. The corrugated outer conductor is preferably cut off at substantially the apex of one of the crests of the corrugations so as to form an annular flared end on the outer conductor. An O-ring is seated in one of the valleys of the outer conductor and bears against the inner surface of the clamping member to provide a moisture seal between the outer conductor and the clamping member.

14 Claims, 3 Drawing Figures

CONNECTOR FOR COAXIAL CABLE WITH ANNULARLY CORRUGATED OUTER CONDUCTOR

DESCRIPTION OF THE INVENTION

This invention relates generally to connectors for coaxial cables, and, more particularly, to connectors for coaxial cables which have annularly corrugated outer conductors.

It is a primary object of the present invention to provide an improved connector, for coaxial cables having annularly corrugated outer conductors, which is easy to install, or to remove and re-install, particularly under field conditions.

One specific object of the invention is to provide such an improved connector which has a minimum number of parts.

Another specific object of the invention is to provide such an improved connector which can be installed and removed without the use of any special tools.

A further object of the invention is to provide such a connector which can be efficiently and economically manufactured.

Other objects and advantages of the invention will be apparent from the following detailed description and the accompanying drawings, in which.

Figure 1:
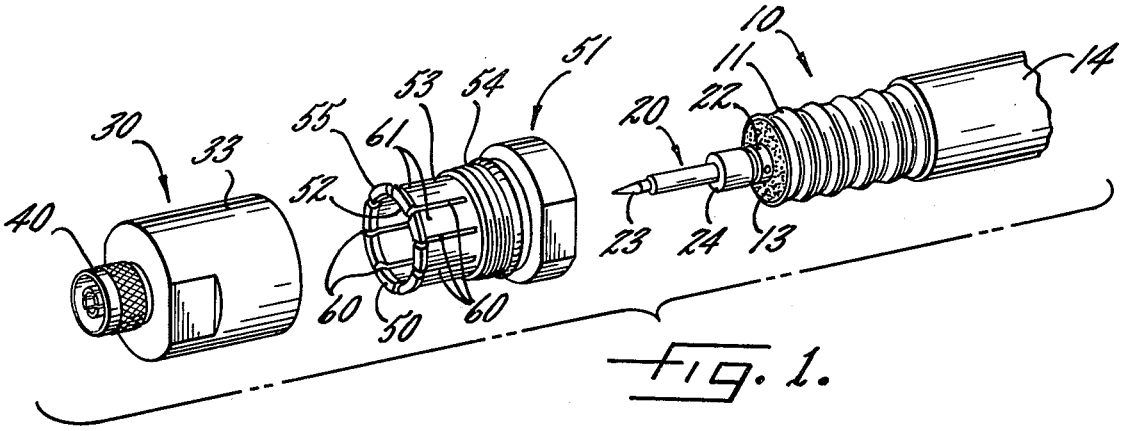
FIG. 1 is a partially exploded perspective view of a connector which embodies the present invention and a coaxial cable having an annularly corrugated outer conductor to be attached to one end of the connector.

Although the invention will be described in connection with a certain preferred embodiment, it will be understood that it is not intended to limit the invention to the particular embodiment. On the contrary, it is intended to cover all alternatives, modifications, and equivalents that may be included within the spirit and scope of the invention as defined by the appended claims.

Turning now to the drawings, there is shown a connector assembly for a coaxial cable 10 having an annularly corrugated outer conductor 11 concentrically spaced from a hollow inner conductor 12 by a foam dielectric 13. As is well known to those familiar with this art, an "annularly" corrugated conductor is distinguished from a "helically" corrugated conductor in that the annular corrugations form a series of spaced parallel crests which are discontinuous along the length of the cable and, similarly, a series of spaced parallel valleys which are also discontinuous along the length of the cable. That is, each crest and valley extends around the circumference of the conductor only once, until it meets itself, and does not continue in the longitudinal direction. Consequently, any transverse cross-section taken through the conductor perpendicular to its axis is radially symmetrical, which is not true of helically corrugated conductors.

To prepare the cable 10 for attachment of the connector assembly, the end of the cable is cut along a plane extending through the apex of one of the crests of the corrugated outer conductor and perpendicular to the axis of the cable. This exposes the clean and somewhat flared internal surface of the outer conductor 11. The foam dielectric 13 normally does not fill the crests of the corrugated outer conductor 11, so a small area of the inner surface of the outer conductor is exposed adjacent the cut end of this conductor at the apex of the crest through which the cut is made; however, if the foam dielectric does fill the entire crest, then a portion of the dielectric should be removed to permit contact with the inner surface of the outer conductor 11 adjacent the cut end thereof. Any burrs or rough edges on the cut ends of the metal conductors are preferably removed to avoid interference with the connector. The outer surface of the outer conductor 11 is normally covered with a plastic jacket 14 which is trimmed away from the end of the outer conductor 11 along a sufficient length to accommodate the connector assembly.

Electrical contact with the inner conductor 12 of the cable 10 is effected by a conventional connector element 20 having a threaded anchoring member 21 which is self-tapping as it is threaded into the hollow conductor 12, an enlarged collar 22 which engages the end of the inner conductor, an elongated pin 23 for connecting the inner conductor to a conventional complementary female member (not shown), and an insulator 24 for centering the pin 23 within the main body member 30 of the connector assembly while electrically isolating these two elements from each other. It will be noted that the interior of the body member 30 includes a recess 31 for receiving the insulator 24, which is also conventional in the art of coaxial cable connectors.

The coupling nut 40 secured to the body member 30 around the pin 23 is also a conventional fitting, and is secured to the body member by a spring retaining ring 41 which holds the nut 40 captive on the member 30 while permitting free rotation of the nut 40 on the member 30. As will be apparent from the ensuing description, this coupling nut 40 serves as a part of the electrical connection to the outer conductor of the cable 10, and is insulated from the inner conductor by the insulator 24 carried by the inner connector pin 23.

Turning next to that portion of the connector assembly which makes electrical connection with the outer conductor 11 of the coaxial cable 10, the body member 30 includes a conically beveled clamping surface 32 which engages the inner surface of the outer conductor 11. This clamping surface 32 is formed as an integral part of the interior surface of the body member 30, and is continuous around the entire circumference of the cable to ensure good electrical contact with the inner surface of the outer conductor 11. Because this clamping surface 32 is formed as an integral part of the body member 30, rather than as a separate insert, it facilitates handling and installation of the connector assembly, particularly under field conditions where small parts are often dropped and lost.

Cooperating with the clamping surface 32 is a second clamping surface 50 formed on one end of an annular clamping member 51 for engaging the outer surface of the outer conductor 11. More specifically, this outer clamping surface 50 is formed on one side of an inner bead 52 which projects from the inside surface of the clamping member 51 into the last valley of the corrugated outer conductor 11 adjacent the end of the cable so as to lock the clamping member 51 to the cable 10 in the axial direction.

For the purpose of drawing the two clamping surfaces 32 and 50 firmly against opposite sides of the flared end portion of the outer conductor 11, the two members 30 and 51 include respective telescoping sleeve portions 33 and 53 with cooperating threaded surfaces 34 and 54. Thus, when the two members 30 and 51 are rotated relative to each other in a first direction, they are advanced toward each other in the axial direction so as to draw the clamping surfaces 32 and 50 into electrically conductive engagement with the outer conductor 11. When the annular flared end portion of the outer conductor 11 is clamped between the two surfaces 32 and 51, it is also flattened to confirm with the planar configuration of the clamping surfaces 32 and 50. Of course, the clamping surfaces could be provided with other configurations more closely approaching the original profile of the flared end portion of the outer conductor if desired. To detach the connector assembly from the outer conductor 11, the two members 30 and 51 are simply rotated relative to each other in the opposite direction to retract the two members away from each other until the threaded surfaces 34 and 54 are disengaged.

Figure 2:
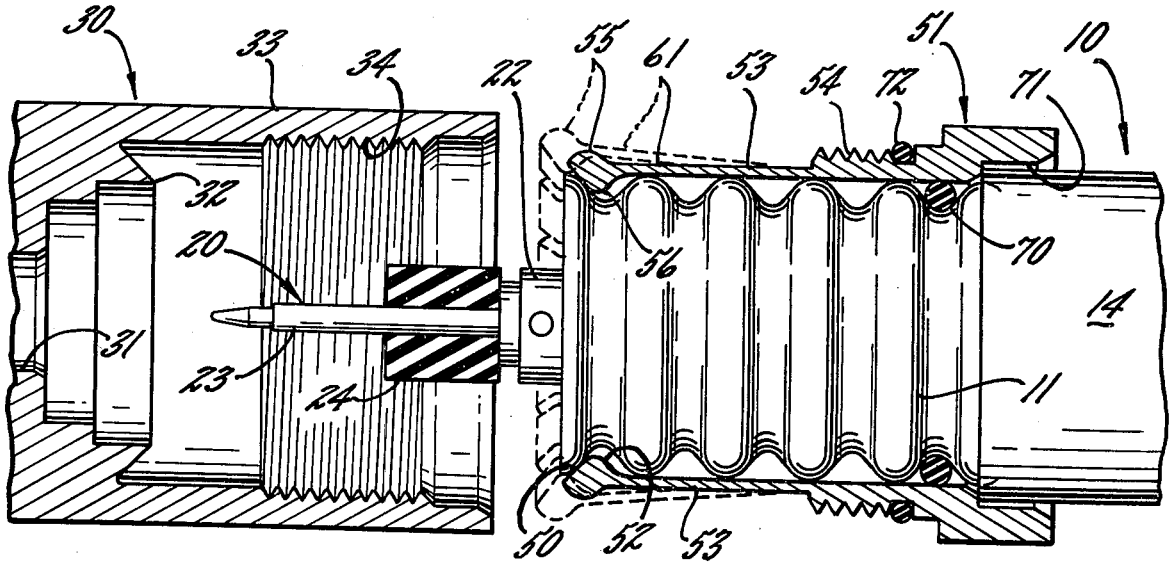
FIG. 2 is a longitudinal section of the connector shown in FIG. 1 with only one of the parts attached to the coaxial cable.
Figure 3:
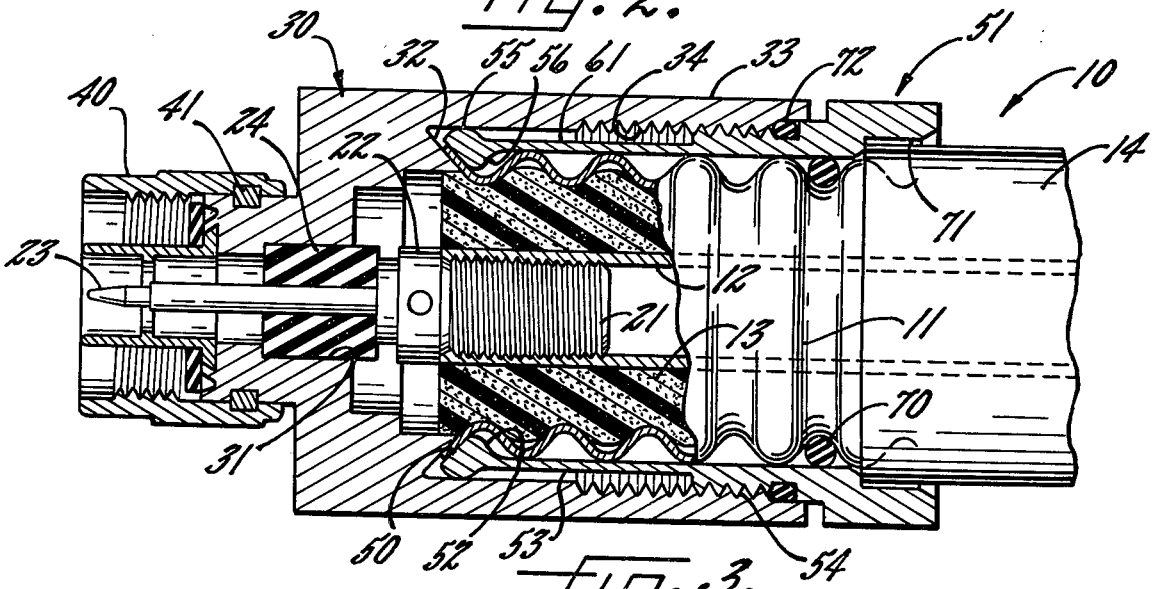
FIG. 3 is the same longitudinal section shown in FIG. 2 with the connector fully assembled.

In accordance with an important aspect of the present invention, clamping member 51 has a plurality of longitudinal slits formed in the beaded end thereof to form a plurality of resilient segments that can be displaced outwardly to permit the bead to pass over the crest of the corrugated outer conductor as the clamping member is advanced longitudinally over the end of the cable. Thus, in the illustrative embodiment, eight slits 60 are formed in the beaded end of the clamping member 51, extending through the bead 52 and into a substantial length of the sleeve portion 53. The slits 60 thus form a plurality of resilient segments 61 which act like spring fingers when a radial force is applied thereto. Consequently, when the sleeve portion 53 of the member 51 is slipped over the cable 10 with the bead 52 engaging the cut edge of the outer conductor 11, continued application of pressure to the member 51 causes the resilient segments 61 to be deflected radially outwardly until the bead 52 clears the crest at the end of the corrugated outer conductor 11, as illustrated in broken lines in FIG. 2. The bead 52 then slides over the crest of the outer conductor 11 and snaps into the last corrugation valley, as illustrated in FIGS. 2 and 3, thereby locking the clamping member 51 to the cable 10 in the axial direction.

In order to facilitate the outward deflection of the resilient segments 61 as the clamping member 61 is urged onto the cable 10, the right-hand side of the inner bead 52, as viewed in the drawings, forms a smoothly curved cam surface 56. This cam surface 56 engages the cut end of the outer conductor 11 and forces the resilient segments 61 outwardly as the member 51 is advanced over the cable 10 during installation of the connector assembly.

For the purpose of avoiding rotation of the clamping member 51 around the cable 10 while the body member 30 is threaded thereover, a raised bead 55 projects from the outer surface of the member 51. As can be seen most clearly in FIG. 3, this bead 55 minimizes the area of frictional engagement between the two members 30 and 51, and spaces the unthreaded portions of the opposed surfaces of these two members away from each other. After the two members 30 and 51 are threaded together, the engagement of the inner surface of the body member 30 with the outer bead 55 maintains the locking action of the inner bead 52 by preventing any outward deflection of the resilient segments 61 as long as the two members 30 and 51 remain connected.

To provide a moisture barrier between the inner surface of the clamping member 51 and the outer surface of the cable conductor 11, an O-ring 70 is positioned in a valley on the exposed portion of the outer conductor 11 before the clamping member 51 is applied thereto. Then when the clamping member 51 is installed on the cable, it slightly compresses the rubber O-ring 70 so that the O-ring bears firmly against both the outer surface of the conductor 11 and the inner surface of the clamping member 51. The adjacent end portion of the clamping member 51 forms a slightly enlarged recess 71 so that it can fit over the end of the plastic jacket 14 on the coaxial cable, with the end of this recess 71 being slightly flared to facilitate entry of the end portion of the jacket 14 into the end of the clamping member 51. A moisture barrier similar to that provided by the resilient O-ring 70 is provided by a second O-ring 72 positioned between the opposed surfaces of the sleeve portions 33 and 53 of the members 30 and 51, respectively.

While the invention has been described with specific reference to a particular preferred embodiment, it will be understood that various modifications may be made while still retaining many of the advantages of the invention. For example, the conically beveled clamping surface 32 associated with the body member 30 could be formed by a separate insert rather than as an integral part of the body member.

As can be seen from the foregoing detailed description of the illustrative embodiment of the invention, the improved connector assembly is easy to install, remove, and re-install, even under adverse field conditions. The connector assembly has a minimum number of parts, so that the possibility of dropping and losing small parts is minimized. Also, the connector assembly is self-flaring and can be easily installed, and removed, with the use of conventional tools, so that no special equipment is required. Moreover, the connector assembly provides positive electrical contact, particularly with the annularly corrugated outer conductor, to ensure reliabe electrical performance. Furthermore, the connector assembly can be efficiently and economically manufactured so that all the practical and performance advantages of the assembly are achieved without any economic sacrifice.

We claim as our invention:

1. A connector assembly for a coaxial cable having an annularly corrugated outer conductor, said connector assembly comprising the combination of a. a first unitary clamping member adapted to fit over the end of the coaxial cable and forming an inwardly extending bead at one end thereof for meshing with the last valley in the corrugated outer conductor and thereby locking the clamping member to the cable in the axial direction, said bead forming a first conically beveled clamping surface for engaging the outer surface of the last crest in the corrugated outer conductor, said first clamping member having a plurality of longitudinal slits formed in the beaded end thereof and extending through and beyond said inwardly extending bead to form a plurality of resilient segments that can be displaced outwardly to permit said bead to pass over the crest of the corrugated outer conductor as the clamping member is advanced longitudinally over the end of the cable, the portion of said first clamping member extending beyond the ends of said slits having an inside diameter at least as great as the outside diameter of the crests of said outer conductor so that the solid portion of said first clamping member fits over said outer conductor, b. a second clamping member forming a second conically beveled clamping surface for engaging the inner surface of the last crest in the corrugated outer conductor of the cable, c. and means for drawing and holding the two clamping surfaces together against opposite surfaces of the outer conductor of the cable.

2. A connector assembly as set forth in claim 1 wherein the locking bead on said first clamping member forms a cam surface for engaging the corrugated outer conductor and urging said resilient segments outwardly as the first clamping member is advanced over the crest of the corrugated outer conductor.

3. A connector assembly as set forth in claim 1 which includes an O-ring adapted to be seated in one of the valleys of the corrugated outer conductor and bearing against the inner surface of said first clamping member to provide a moisture seal between said outer conductor and said first clamping member.

4. A connector assembly as set forth in claim 1 wherein said clamping surfaces are adapted to engage the inner and outer surfaces of a corrugated outer conductor that is cut off at substantially the apex of one of the crests of the corrugations so as to form an annular flared end on the outer conductor.

5. A connector assembly as set forth in claim 1 wherein said second conically beveled clamping surface is formed as an integral part of said second clamping member.

6. A connector assembly as set forth in claim 1 wherein said first and second clamping members include integral telescoping sleeves with cooperating threaded surfaces which form said drawing and holding means.

7. A connector assembly as set forth in claim 6 which includes an outwardly extending bead on the outer surface of said first clamping member to minimize the area of frictional engagement between the unthreaded surfaces of said first and second clamping members.

8. A coaxial cable and connector assembly comprising the combination of a. a coaxial cable having an annularly corrugated outer conductor, b. a first unitary clamping member telescoped over the end of the coaxial cable and forming an inwardly extending bead at one end thereof meshing with the last valley in the corrugated outer conductor and thereby locking the clamping member to the cable in the axial direction, said bead forming a first conically beveled clamping surface engaging the outer surface of the last crest in the corrugated outer conductor, said first clamping member having a plurality of longitudinal slits formed in the beaded end thereof and extending through and beyond said inwardly extending bead to form a plurality of resilient segments that can be displaced outwardly to permit said bead to pass over the crest of the corrugated outer conductor as the clamping member is advanced longitudinally over the end of the cable, the portion of said first clamping member extending beyond the ends of said slits having an inside diameter at least as great as the outside diameter of the crests of said outer conductor so that the solid portion of said first clamping member fits over said outer conductor, c. a second clamping member forming a second conically beveled clamping surface for engaging the inner surface of the last crest in the corrugated outer conductor of the cable, d. and means for holding the two clamping surfaces together against opposite surfaces of the outer conductor of the cable.

9. A coaxial cable and connector assembly as set forth in claim 8 wherein the locking bead on said first clamping member forms a cam surface for engaging the corrugated outer conductor and urging said resilient segments outwardly as the first clamping member is advanced over the crest of the corrugated outer conductor.

10. A coaxial cable and connector assembly as set forth in claim 8 which includes an O-ring seated in one of the valleys of the corrugated outer conductor and bearing against the inner surface of said first clamping member to provide a moisture seal between said outer conductor and said first clamping member.

11. A coaxial cable and connector assembly as set forth in claim 8 wherein said corrugated outer conductor is cut off at substantially the apex of one of the crests of the corrugations so as to form an annular flared end on the outer conductor.

12. A coaxial cable and connector assembly as set forth in claim 8 wherein said second conically beveled clamping surface is formed as an integral part of said second clamping member.

13. A coaxial cable and connector assembly as set forth in claim 8 wherein said first and second clamping members include integral telescoping sleeves with cooperating threaded surfaces which form said holding means.

14. A coaxial cable and connector assembly as set forth in claim 13 which includes an outwardly extending bead on the outer surface of said first clamping member to minimize the area of frictional engagement between the unthreaded surfaces of said first and second clamping members.

* * * * *